US005934604A

United States Patent [19]

Klimek

[11] Patent Number: 5,934,604

[45] Date of Patent: Aug. 10, 1999

[54] CENTER DRIVE UNWIND SYSTEM

[75] Inventor: Wayne D. Klimek, Green Bay, Wis.

[73] Assignee: Paper Converting Machine Company, Green Bay, Wis.

[21] Appl. No.: 09/170,520

[22] Filed: Oct. 13, 1998

[51] Int. Cl.[6] ..... B65H 19/00

[52] U.S. Cl. ..... 242/559.4; 242/558; 242/557; 242/563

[58] Field of Search ..... 242/555.1, 555.2, 242/555.3, 557, 558, 559, 559.3, 559.4, 563, 563.1

[56] References Cited

U.S. PATENT DOCUMENTS

| | | | |
|---|---|---|---|
| 2,535,815 | 12/1950 | Seeger | 242/559 |
| 2,571,947 | 10/1951 | Russell | 242/559.4 |
| 3,690,583 | 9/1972 | Herman . | |
| 3,740,296 | 6/1973 | McDonald . | |
| 3,743,198 | 7/1973 | Lucas . | |
| 4,021,002 | 5/1977 | Meihofer . | |
| 4,131,206 | 12/1978 | Kawada et al. | 242/559.4 |
| 4,132,371 | 1/1979 | Byrt . | |
| 4,236,449 | 12/1980 | Price . | |
| 4,466,577 | 8/1984 | Focke . | |
| 4,586,673 | 5/1986 | Tokuno . | |
| 4,767,076 | 8/1988 | Tagawa . | |
| 4,773,609 | 9/1988 | Steffen . | |
| 4,919,353 | 4/1990 | Isowa . | |
| 4,948,060 | 8/1990 | Kurz et al. | 242/559.4 |
| 5,004,173 | 4/1991 | Kawai . | |
| 5,025,998 | 6/1991 | Hutzenlaub . | |
| 5,219,127 | 6/1993 | Boldrini . | |
| 5,299,751 | 4/1994 | Pichlmair . | |
| 5,316,231 | 5/1994 | Thievessen et al. | 242/559.4 |
| 5,421,691 | 6/1995 | Ferrone | 242/559.4 |
| 5,697,575 | 12/1997 | Moore et al. | 242/559.4 |
| 5,716,022 | 2/1998 | Chiloff | 242/557 |

*Primary Examiner*—Donald P. Walsh
*Assistant Examiner*—Emmanuel M. Marcelo
*Attorney, Agent, or Firm*—Tilton, Fallon, Lungmus & Chestnut

[57] ABSTRACT

A center driven unwind system for core-equipped parent rolls includes a frame for supporting the parent roll while it is being unwound, a parent roll placement cart for moving a parent roll from a loading position to the unwinding position on the frame, and a core removal cart for removing an unwound parent roll from the frame.

16 Claims, 18 Drawing Sheets

CENTER DRIVE UNWIND SYSTEM

BACKGROUND AND SUMMARY OF INVENTION

This invention relates to a center drive unwind system and, more particularly, to an unwind system which is especially advantageous in unwinding very large diameter parent rolls for subsequent rewinding into retail sized products.

BACKGROUND OF THE INVENTION

This invention is a modification of the center drive unwind system which is described in co-owned U.S. patent application Ser. No. 08/838,278, filed Apr. 16, 1997, now U.S. Pat. No.

Unwinds are used widely in the paper converting industry, particularly in the production of bathroom tissue and kitchen toweling. These hold parent rolls which are unwound for cross perforation and rewinding into retail-sized logs or rolls. At the time a parent roll runs out in a traditional operation, the spent shaft or core must be removed from the machine, and a new roll moved into position by various means such as an overhead crane, extended level rails, etc.

Historically, the unwinds made use of core shafts or core plugs for support on unwind stands with the power for unwinding coming from belts on the parent roll surface. In contrast, center driving has been used mainly in unwinding more tightly wound rolls such as film.

In the center drive unwind system which is described in U.S. Ser. No. 08/838,278, the parent roll, instead of being surface driven (via driven surface belts), is center driven (through the core). The unwind stand includes a pair of horizontally spaced-apart side frames defining the beginning of a path of travel of the web being unwound from a parent roll for processing by a rewinder at the end of the path. An elongated arm is pivotally mounted on each side frame with the mounting being adjacent one end of each arm and with each arm adjacent the other end being equipped with retractable chuck means for insertion into a parent roll core.

Variable speed drive means are operably associated with each chuck means and are adapted to develop an increasing rotational speed characteristic in the chuck means as a parent roll carried by the chuck means is unwound. Sensor means are provided on the arms for positioning the chuck means for introduction into the core of a parent roll to be subsequently unwound.

A core table adjacent the frame is adapted to receive from the arm means a partially unwound parent roll. The core table is equipped with cradle means for rotatably supporting the partially unwound roll after the chuck means have been retracted therefrom.

Positioned adjacent the end of the web path, i.e., adjacent the entering end of the rewinder, is a means for combining the leading end portion of the web from the "new" parent roll with the trailing end portion of the substantially unwound parent roll for simultaneous introduction into the rewinder. This is advantageously in the form of a thread-up conveyor utilizing vacuum.

SUMMARY OF THE INVENTION

The invention eliminates the pivoting arms which are described in U.S. Ser. No. 08/838,278, and the parent roll drive is mounted in fixed frames. A cart transports a new parent roll to the parent roll drive for chucking. After the new roll is chucked, the cart lowers and returns to a position where another roll can be placed on the cart. When the roll is almost completely unwound or expired, a second cart is positioned under the nearly expired roll and is raised to the height of the surface of the roll. The roll is unchucked onto the second cart, and the second cart is moved to an unload position as the first cart moves a new parent roll into the drive position. After thread up, the second cart expels the expired core onto a conveyor located outside of the machine.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
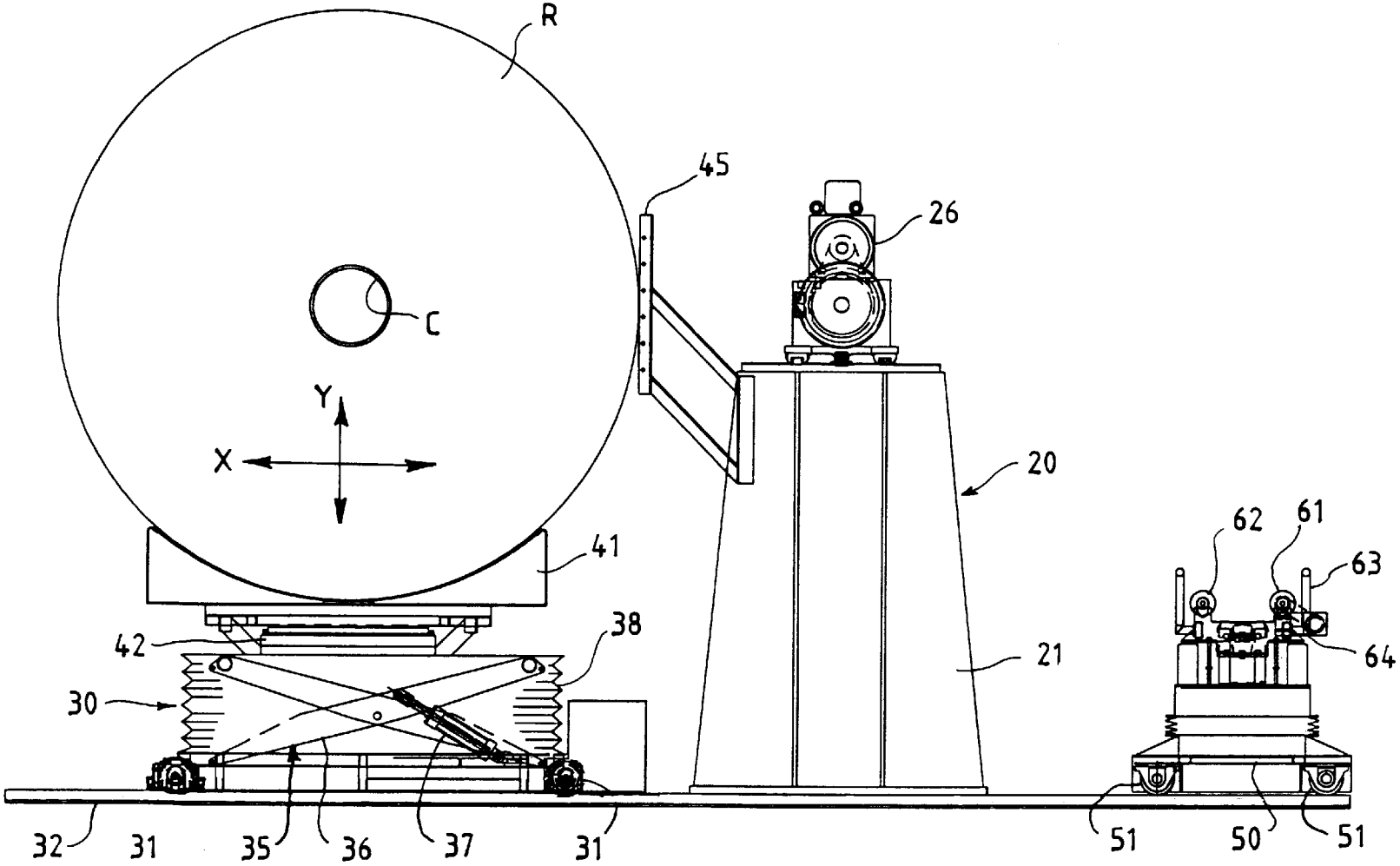
FIG. 1 illustrates the unwind being loaded with a new parent roll for the first time.
Figure 2:
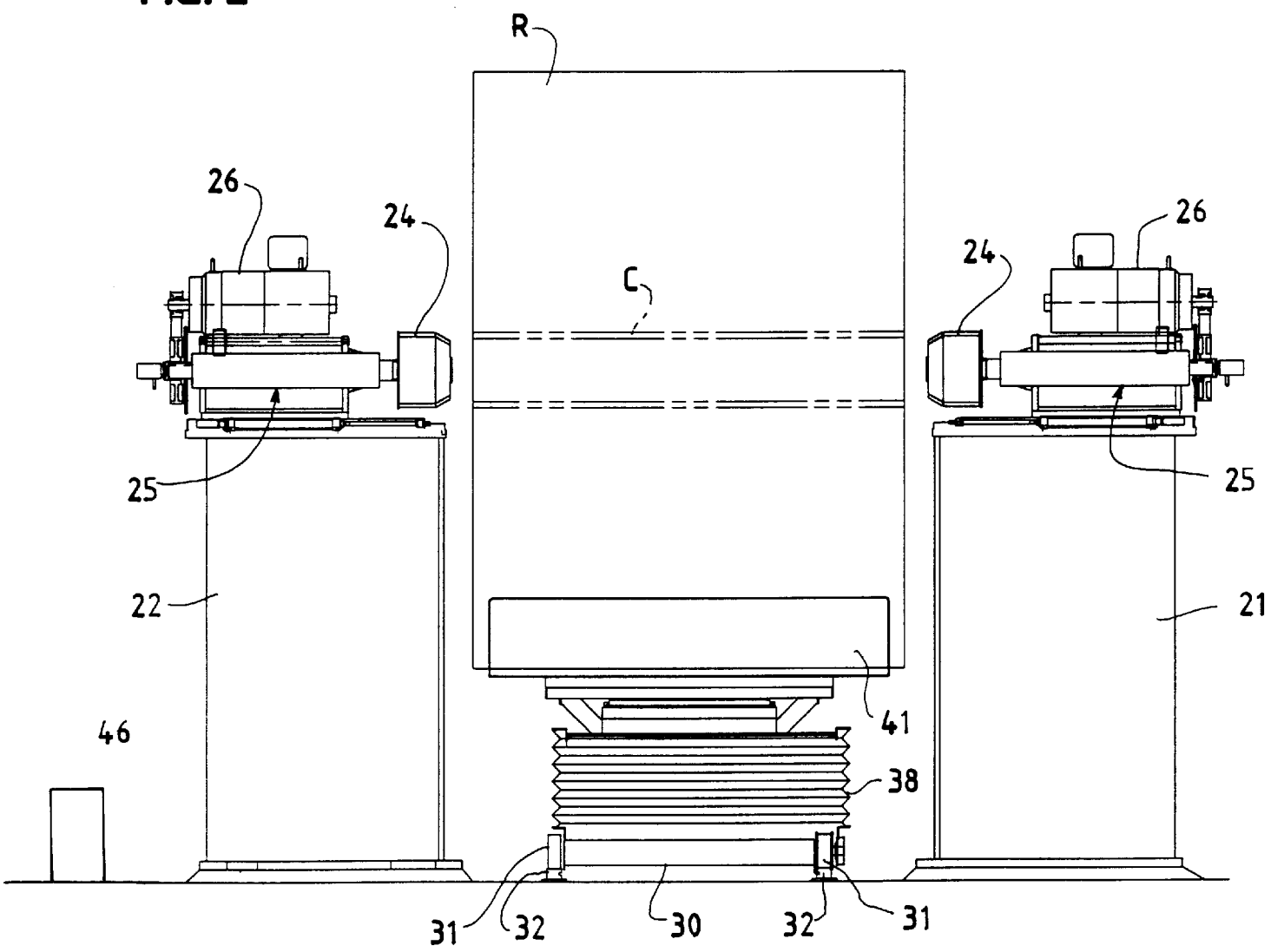
FIG. 2 is an end view showing the parent roll placement cart in the loading position between the core chuck assemblies.

Referring to FIGS. 1 and 2, the numeral 20 designates generally a frame for the unwind stand which includes a pair of side frames 21 and 22. Each of the side frames supports a core chuck 24. Each chuck can be extended and retracted by a cylinder and piston assembly 25, and each chuck can be rotated by a motor 26.

A new parent roll R is about to be installed in the unwind stand and is supported by a parent roll placement cart 30. The parent roll placement cart includes means for moving the cart in both the x and y directions, i.e., horizontally and vertically as viewed in FIG. 1.

In the particular embodiment illustrated, the means for moving the parent roll placement cart horizontally comprises wheels 31 which are rotatably mounted on the cart and which ride on rails 32. The wheels on one or both ends of the cart are driven by a motor, for example, a hydraulic motor, or by equivalent drive means such as a cylinder.

The means for moving the cart vertically comprises a hydraulic lift assembly 35 which includes scissors lift arms 36 and a hydraulic piston 37 and cylinder assembly. A bellows 38 covers the lift mechanism.

Other mechanisms can be used to move the parent roll placement cart in either the x or y direction. Feedback devices such as Temposonic Model LPRMAU01201 and RHS2080URG01A01 or other devices can be used to position the parent roll placement cart in the x and y axes. The feedback devices for the x axis can be located in the floor which supports the unwind and the rails 32. The feedback devices for the y axis can be located in the piston and cylinder assembly 37.

The lift mechanism supports a cradle 41 on which the parent roll R rests. The parent roll includes a hollow core C at its center. The cradle is pivotable 180° on a pivot support 42 so that the direction in which the web unwinds can be adjusted as desired.

A sensor array 45 is mounted on the unwind stand and detects the edge of the parent roll as the parent roll placement cart moves the roll toward the side frames 21 and 22. The sensor array can comprise photoelectric eyes or similar devices. The sensors provide feedback to a control unit 46 (FIG. 2) so that the control unit can determine the x and y coordinates of the center of the core C and the diameter of the roll. The placement cart is moved along the x and y axes until the core is aligned with the core chucks 24. The control unit 46 is a Model PIC 900 available from Giddings and Lewis of Fond du Lac, Wis.

Figure 3:
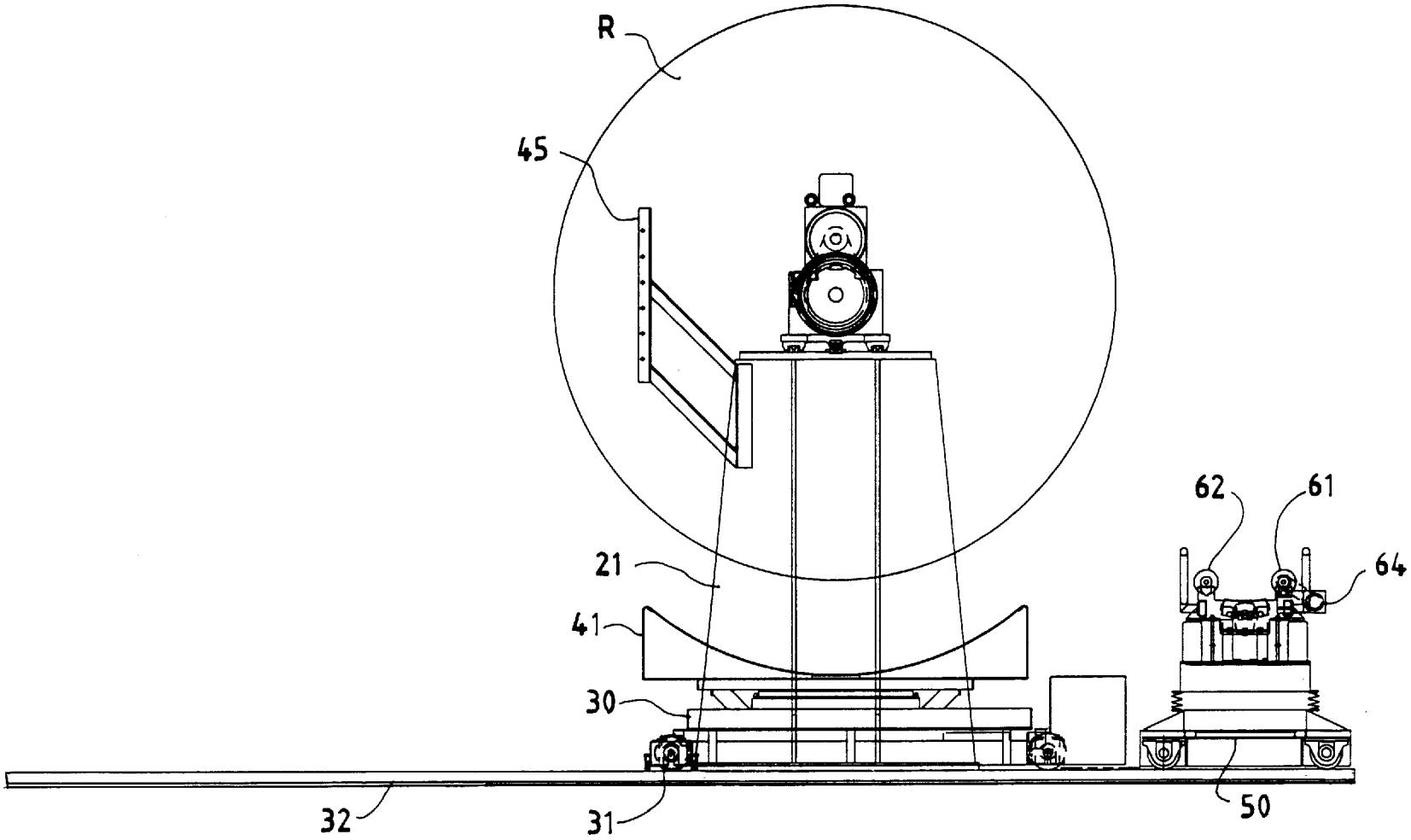
FIG. 3 is a side elevational view showing the parent roll placement cart in a lowered position after the parent roll has been chucked up.
Figure 4:
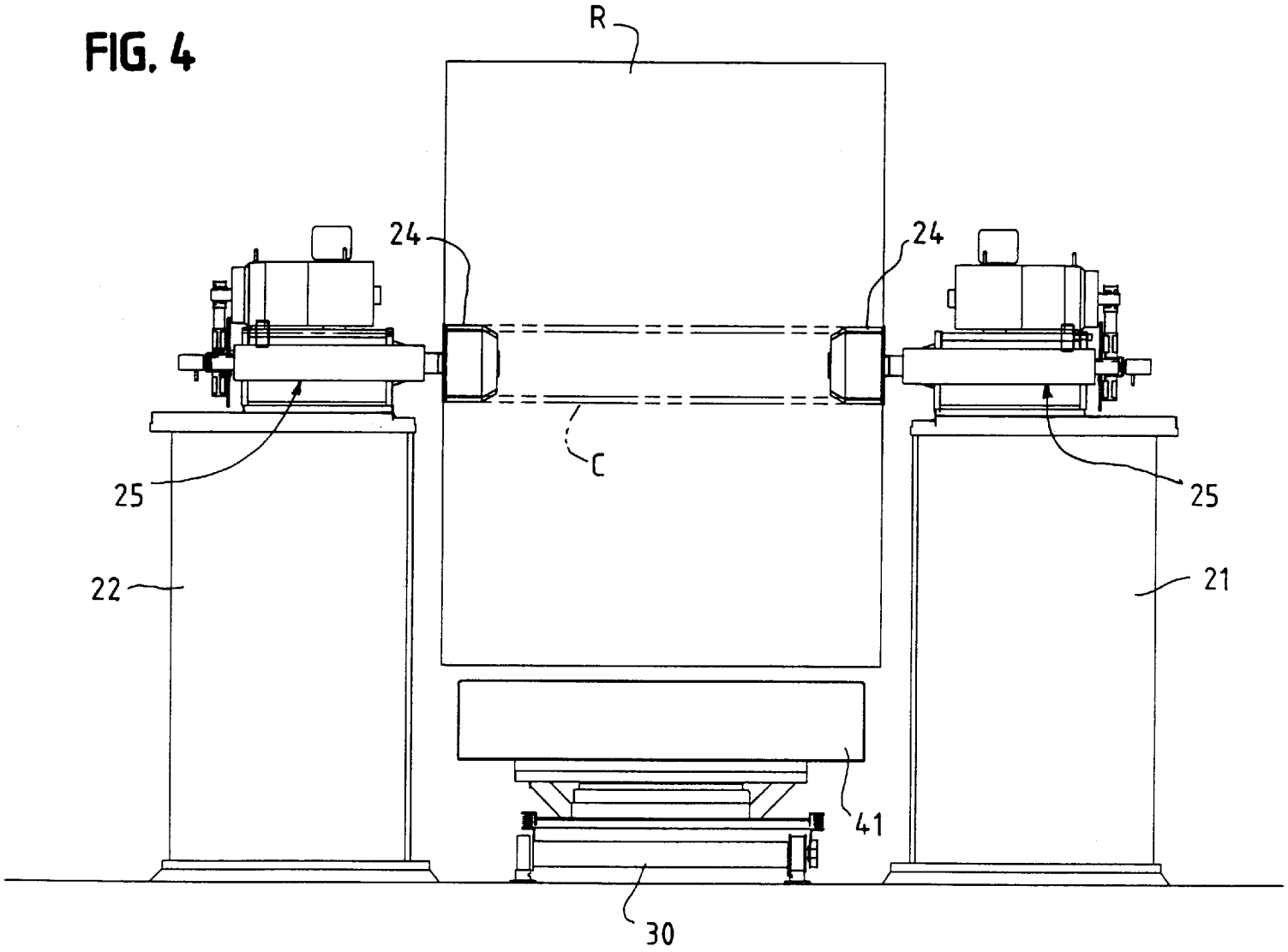
FIG. 4 is an end view showing the parent roll placement cart in the lowered position and the parent roll in the chucked up position.

FIG. 2 illustrates the parent roll placement cart 30 between the side frames 21 and 22. The cradle 41 is raised so that the core C is aligned with the chucks 24. The chucks are extended into contact with the core so that the parent roll can be supported by the chucks. The parent roll placement cart is then moved to a lowered position as shown in FIGS. 3 and 4.

Figure 5:
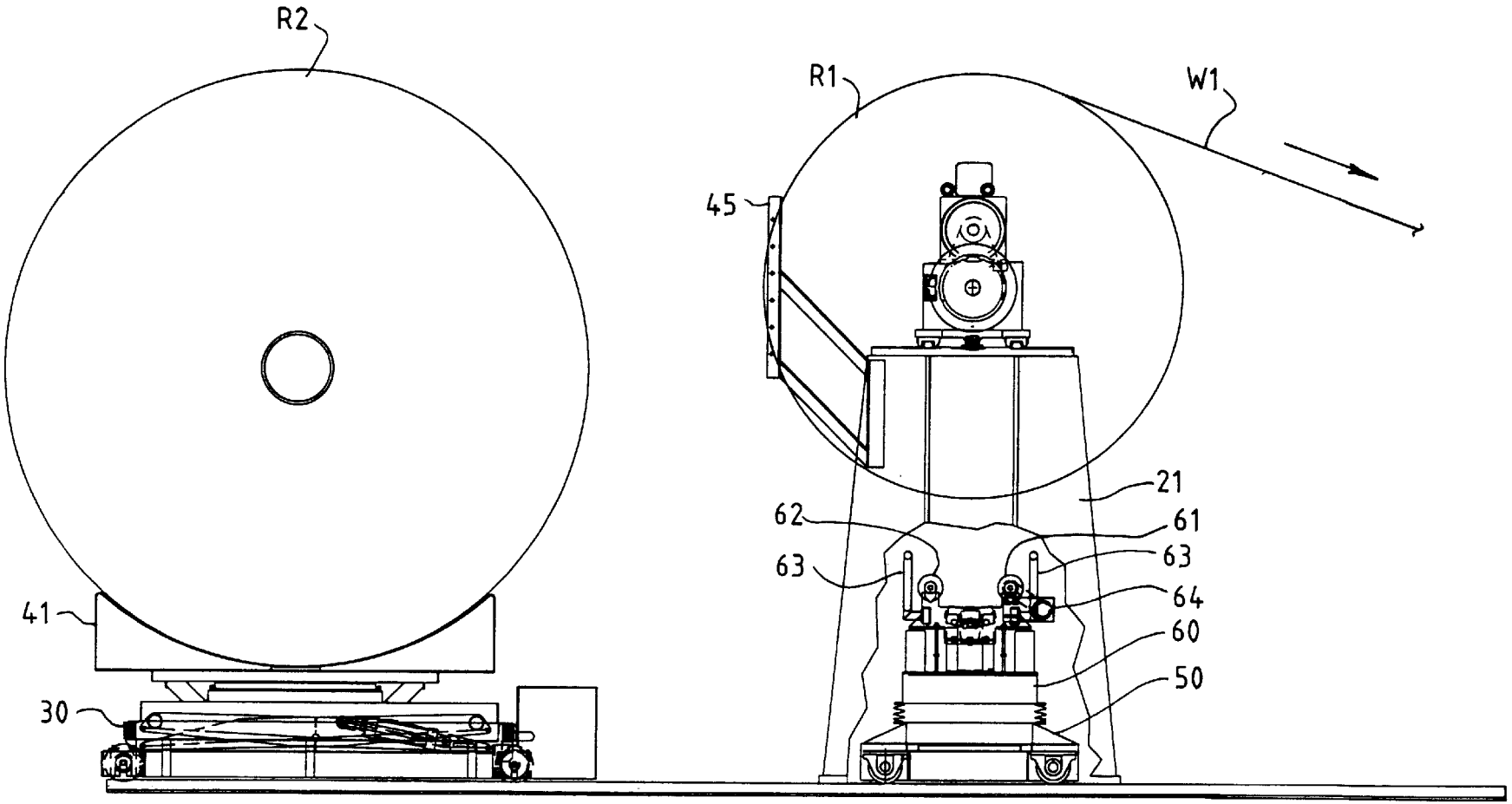
FIG. 5 is a side elevational view showing the parent roll placement cart returned to the parent roll load position and the core removal cart positioned under the parent roll in a lowered position.
Figure 6:
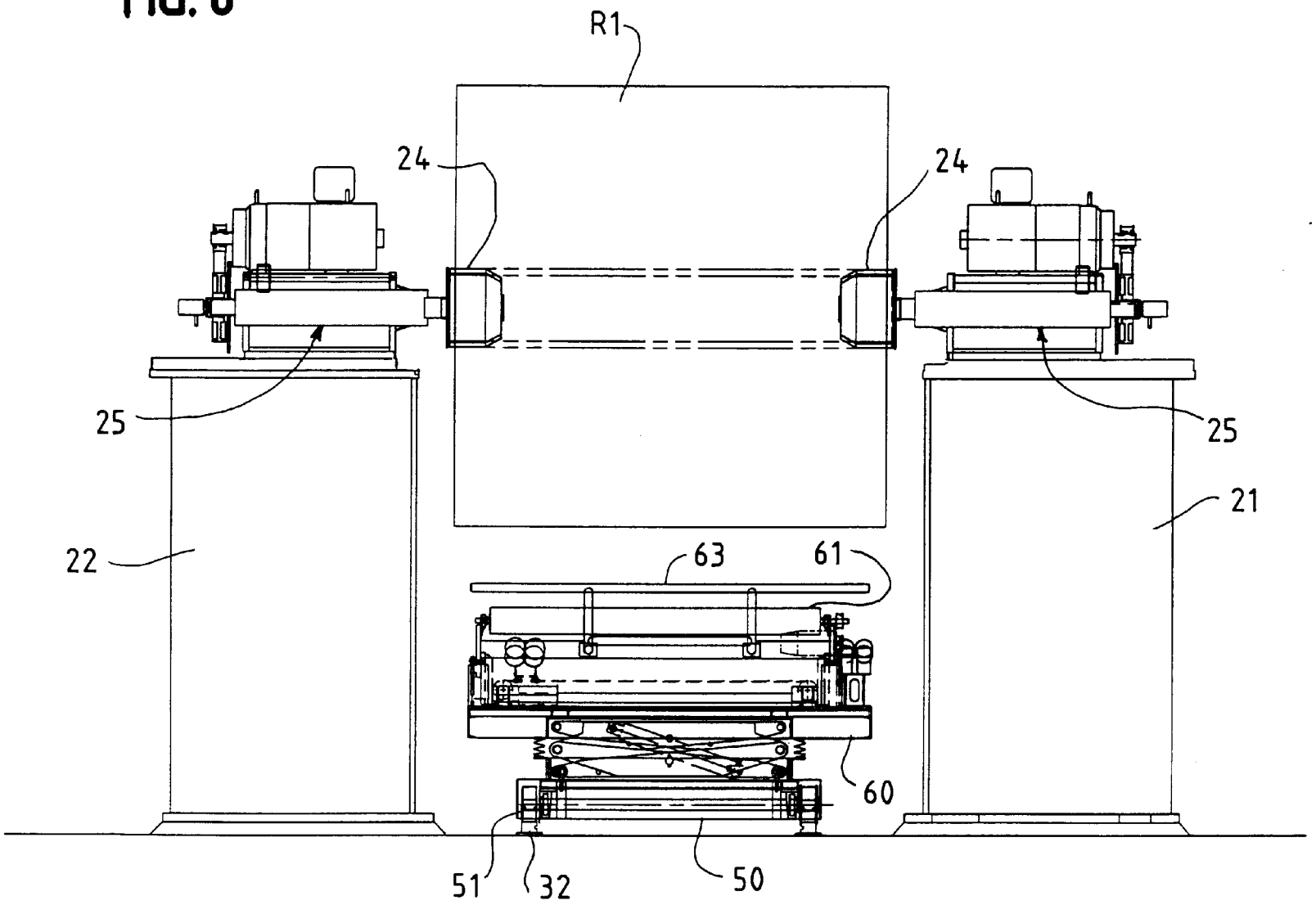
FIG. 6 is an end view showing the core removal cart in the lowered position.

FIG. 5 illustrates a parent roll $R_1$ on the unwind stand. The parent roll is being rotated by the chuck motors, and the web $W_1$ is unwound from the roll and advanced to a rewinder or other web processing device which is downstream from the unwind stand. The parent roll placement cart 30 has been returned to its loading position, and a new parent roll $R_2$ has been loaded onto the cart.

Figure 10:
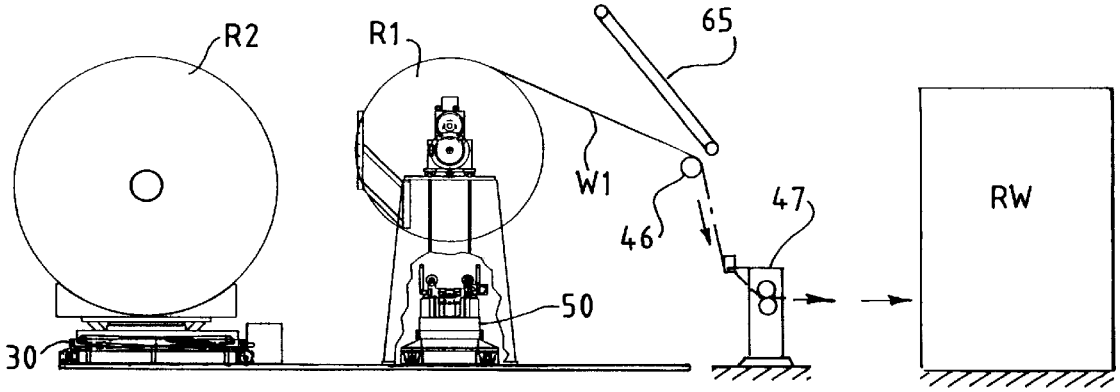
FIG. 10 is a view similar to FIG. 5 showing the web being unwound from the chucked up parent roll and being advanced to a rewinder.

Referring to FIG. 10, the web $W_1$ is advanced from the roll $R_1$ over a roller 46 and through a bonding unit 47. The web is ultimately fed to a rewinder RW or other device for processing the web.

The side frame 21 is broken away in FIGS. 5 and 10 to show a core removal cart 50 which is positioned between the side frames 21 and 22 and below the parent roll $R_1$. The core removal cart also includes means for moving the cart in both the x and y directions.

In the particular embodiment illustrated, the means for moving the core removal cart 50 in the x direction includes wheels 51 which ride on the rails 32. The wheels can be powered by a hydraulic motor or equivalent devices.

The means for moving the cart 50 vertically comprises a hydraulic lift assembly 55 (FIG. 8) which includes a pair of scissors arms 56 and 57 and a hydraulic piston and cylinder assembly 58. Other mechanisms can be used to move the core removal cart in either the x or y directions. A bellows 59 covers the lift mechanism.

The core removal cart is equipped with sensors such as photo eyes or other devices. These devices will indicate when the core removal cart is at the proper height to accept the nearly expired parent roll. Feedback devices such as Temposonic Model LPRMAU02201 and RHS1100URG01A01 or other devices are used to verify the position along both the x and y axes.

The core removal cart includes a core support frame 60 which is supported by the hydraulic lift assembly 55. The support frame includes a pair of rollers 61 and 62 which are rotatably mounted on the core support frame 60 and side rails 63 which contain the expired roll so that it cannot roll off of the rollers 61 and 62. The roller 61 is driven by motor 64, and roller 62 is an idler roller.

Figure 7:
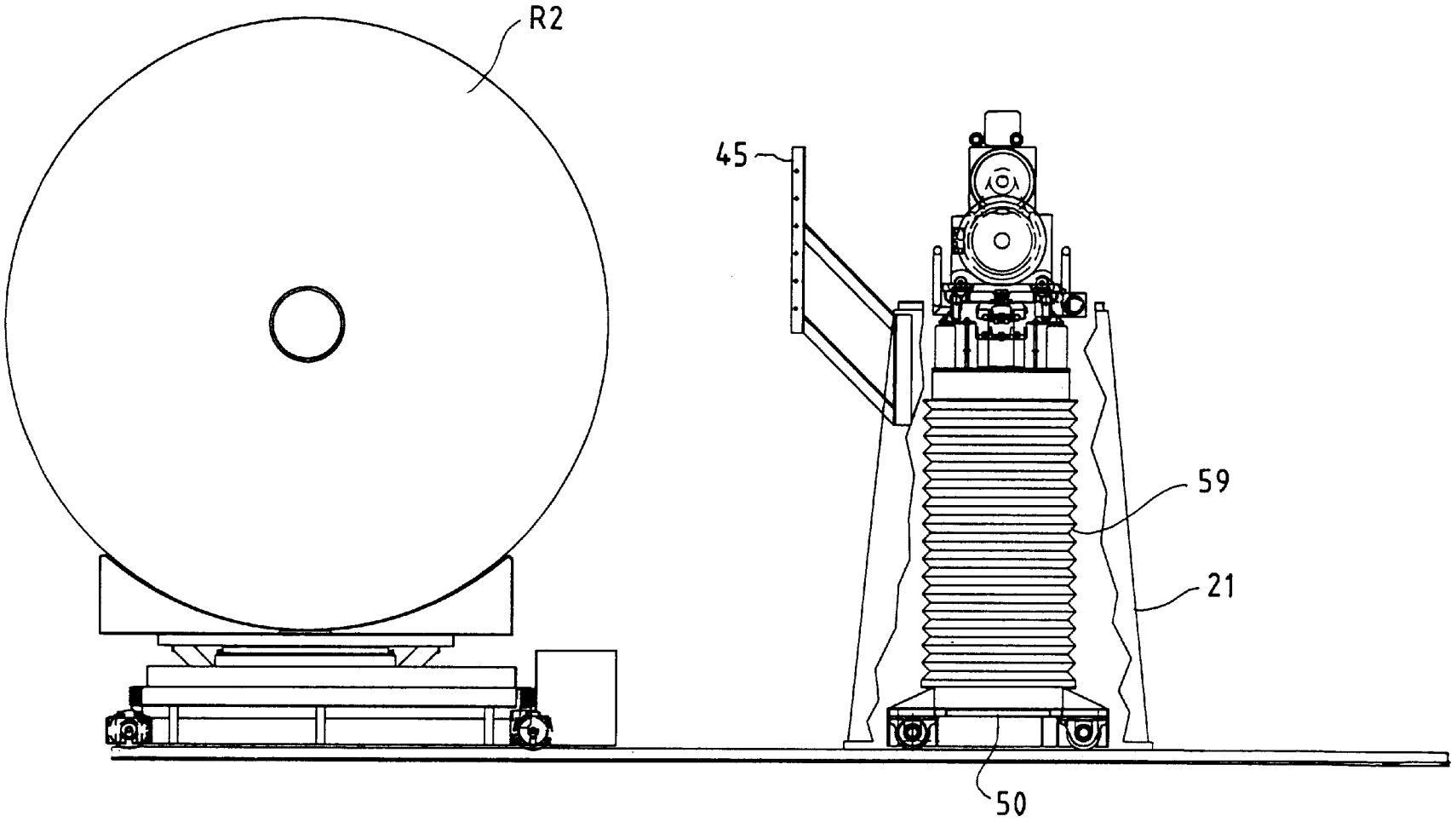
FIG. 7 is a side elevational view showing the parent roll placement cart loaded with a new parent roll and the core removal cart in a raised position for accepting the nearly expired parent roll.
Figure 8:
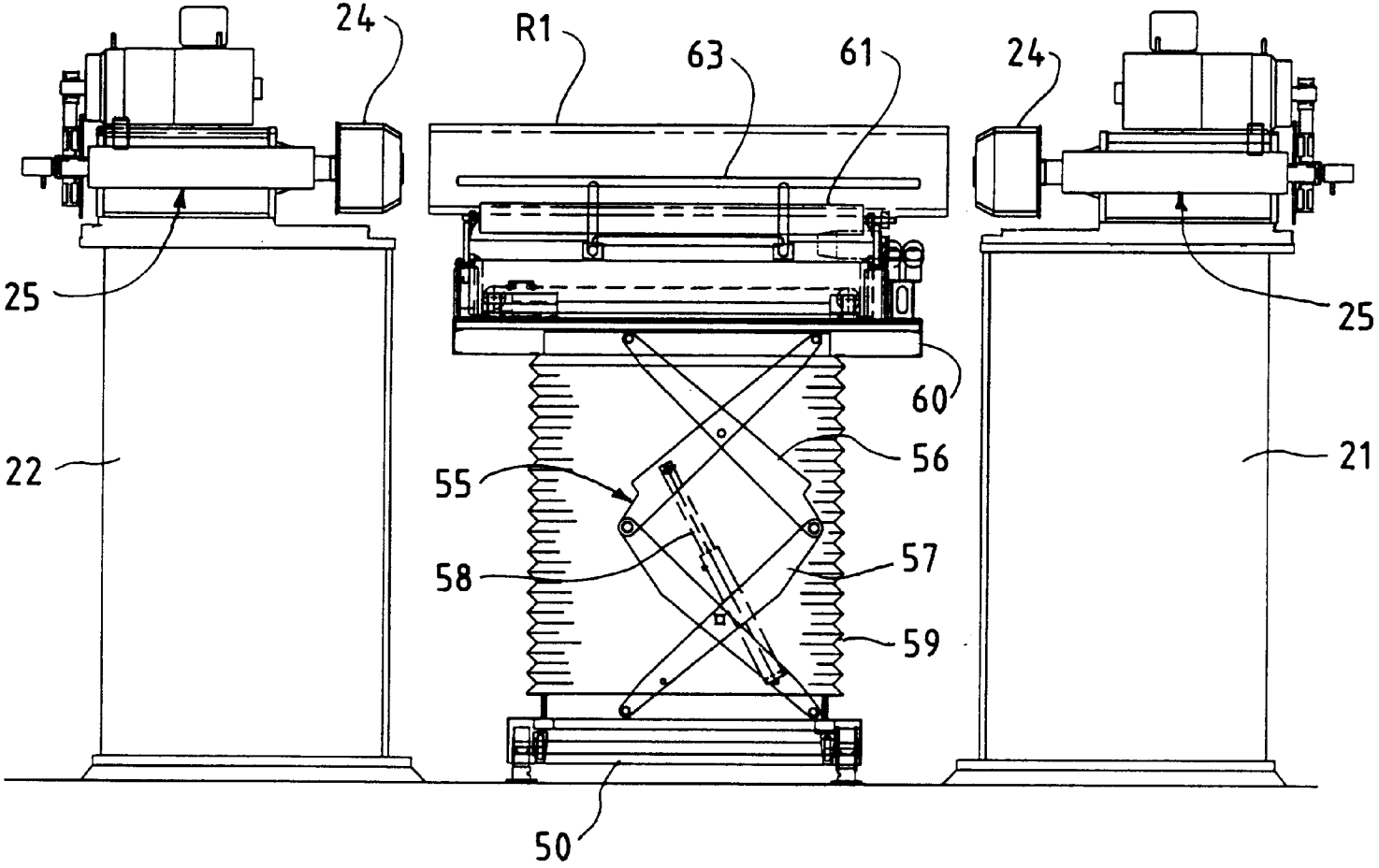
FIG. 8 is an end view showing the nearly expired parent roll supported by the core removal cart with the core chuck assemblies retracted.

When the parent roll $R_1$ is close to being fully unwound, the core removal cart is raised as shown in FIGS. 7 and 8. When the rollers 61 are in position to support the roll, the chucks 24 are retracted from the core, and the nearly expired roll $R_1$ is supported by the core removal cart.

Figure 9:
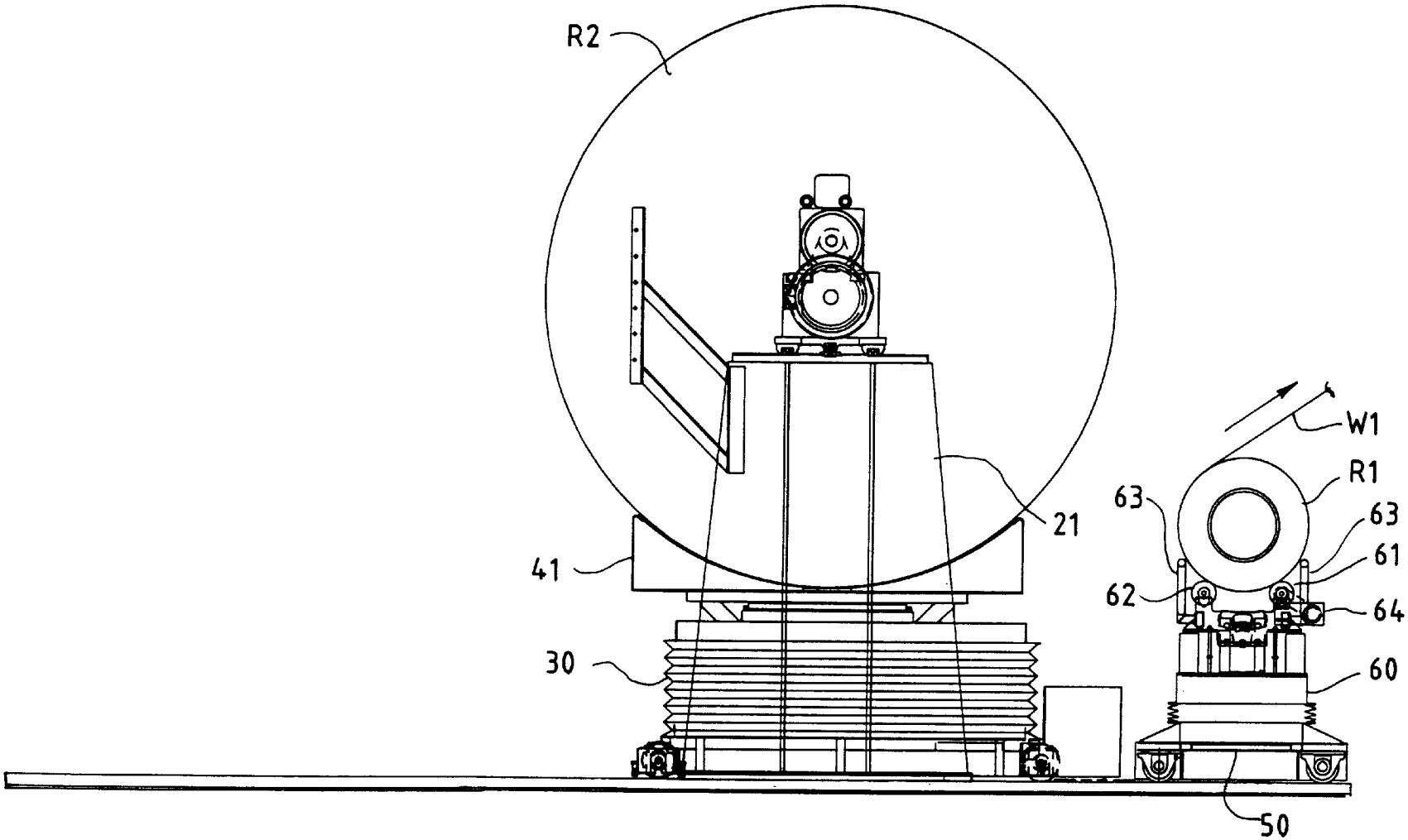
FIG. 9 is a side elevational view showing the core removal cart with the nearly expired parent roll at the discharge position and the new parent roll in the chucked up position.

Referring to FIG. 9, the core removal cart is then moved downstream in the x direction, and the core support frame 60 is moved downwardly in the y direction. The web $W_1$ continues to be unwound from the roll $R_1$ by the driven roller 61. As the web is fed toward the rewinder, the roll $R_1$ rotates on the rollers 61 and 62 and is retained on the rollers by the side rails 63. In the meantime, the parent roll replacement cart 30 has moved the new parent roll $R_2$ into position to be chucked up by the chucks 24.

Figure 11:
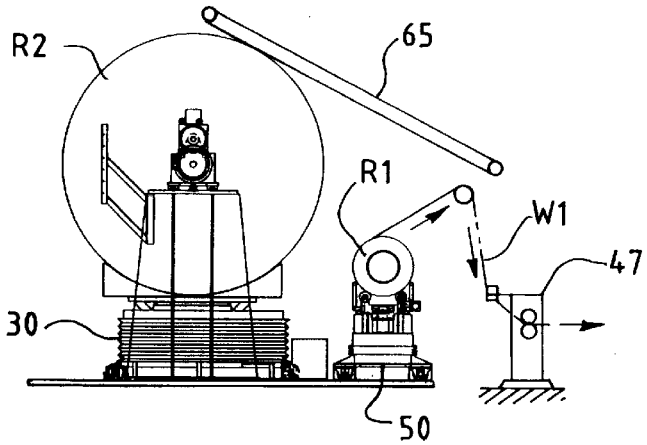
FIG. 11 is a side elevational view showing one of the steps of the thread-up operation.
Figure 12:
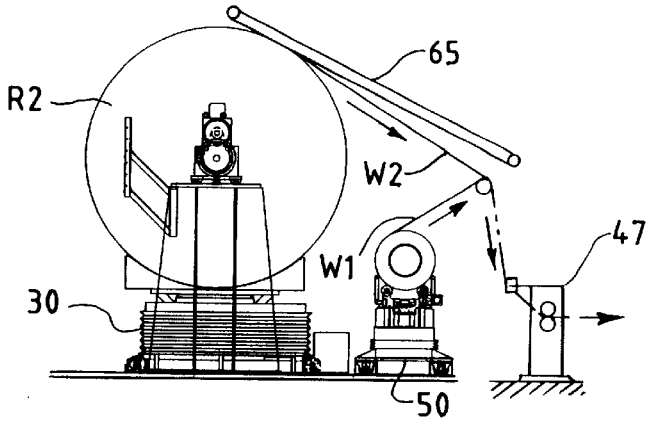
FIG. 12 is a view similar to FIG. 11 showing a subsequent step in the thread-up operation.

FIGS. 11 and 12 illustrate the procedure for threading up the new parent roll $R_2$ while the nearly expired roll $R_1$ continues to feed its web to the rewinder. A more complete description of the thread up procedure may be found in U.S. Ser. No. 08/838,278.

A vacuum thread up conveyor 65 is lowered onto the new roll $R_2$ and picks up the leading edge of the new web $W_2$ of the roll $R_2$ as the roll $R_2$ is rotated by the chucks 24. The vacuum conveyor carries the new web to a position overlying the old web $W_1$ from the roll $R_1$ and drops the new web onto the old web. Both webs are advanced through the bonding unit 47 which bonds the webs together. The bonding unit can use any conventional means for bonding the webs, including tape, adhesive, ply bonding wheels, or the like. Also, the vacuum thread up conveyor can be omitted, and manual thread up of the new web can be used.

After the webs are combined, the web $W_1$ from the expired parent roll $R_1$ is no longer needed, and the motor 64 is stopped to brake the roller 61. The expired parent roll $R_1$ is thereby prevented from turning and the expired web $W_1$ breaks. When appropriate, vacuum to the thread up conveyor is shut off, and the thread up conveyor is raised. The chucks 24 can then be accelerated to normal running speed.

After the expired web $W_1$ is broken, the core removal cart 50 expels the expired core onto a conveyor. FIGS. 13–17 illustrate the means for expelling the expired core.

Figure 14:
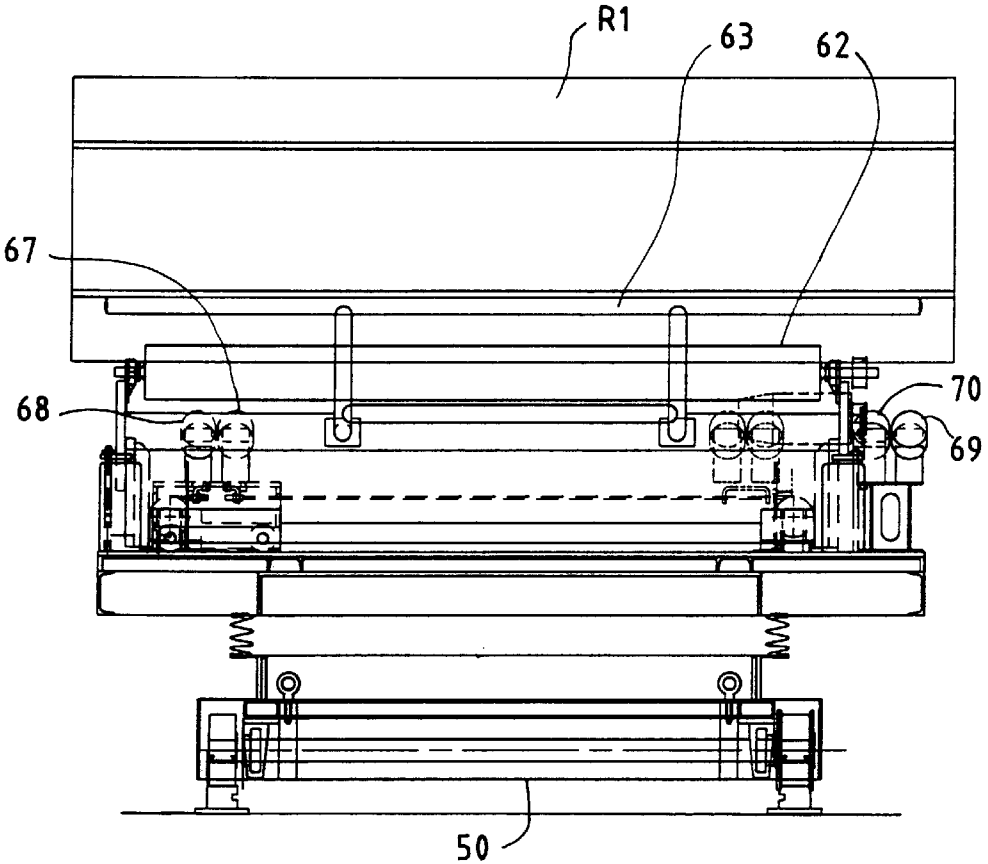
FIG. 14 is a elevational view of the core removal cart taken along the line 14—14 of FIG. 13.
Figure 13:
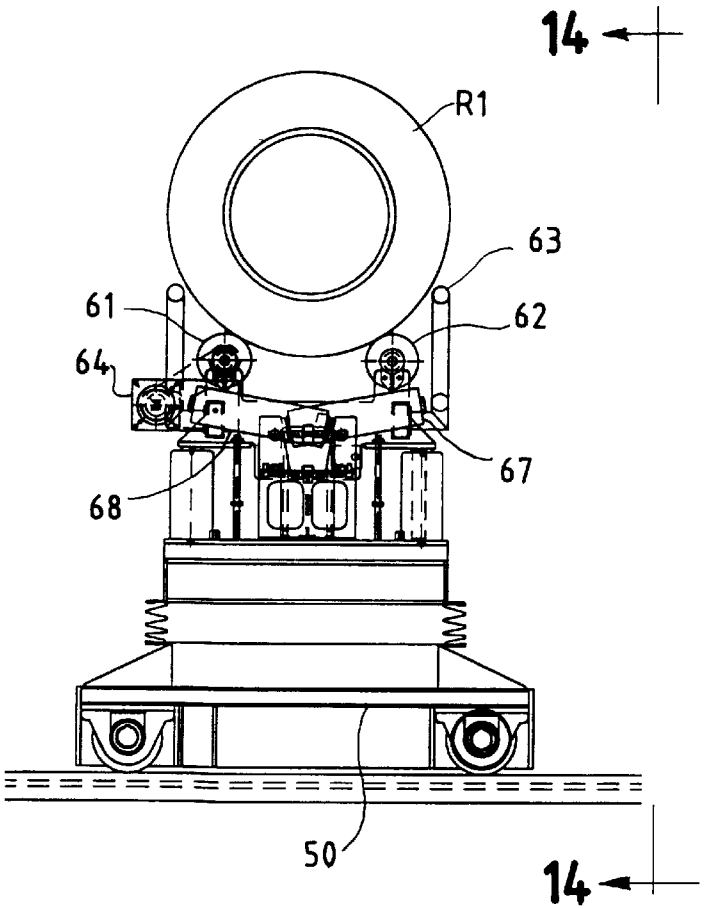
FIG. 13 is an enlarged side elevational view of the core removal cart taken from the opposite side as FIG. 1.

Referring first to FIGS. 13 and 14, a pair of angled rollers 67 and 68 which extend transversely to the axis of the expired roll $R_1$ are mounted on one end of the cart 50, and a corresponding pair of angled rollers 69 and 70 are mounted on the other end of the cart. Before the expired roll is discharged, the roll is supported by the rollers 61 and 62, which are positioned above the end rollers 67–70 in FIGS. 13 and 14.

Figure 16:
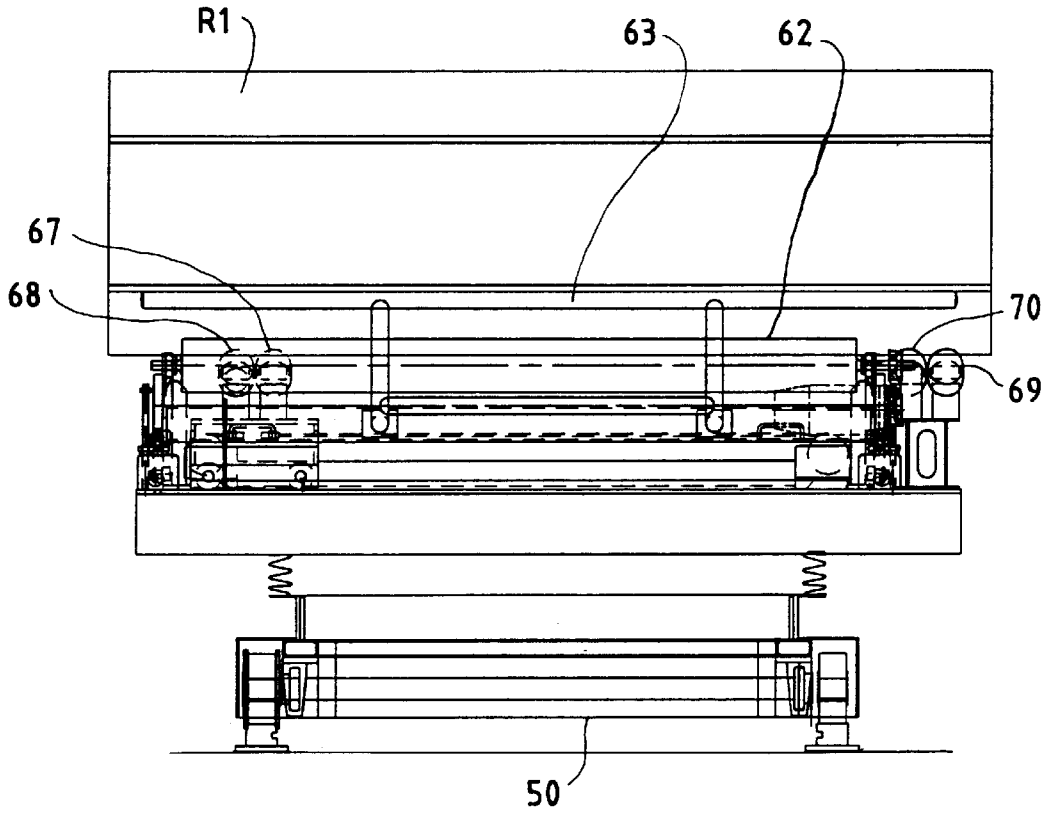
FIG. 16 is a view similar to FIG. 14 showing the roll $R_1$ in a lowered position.
Figure 15:
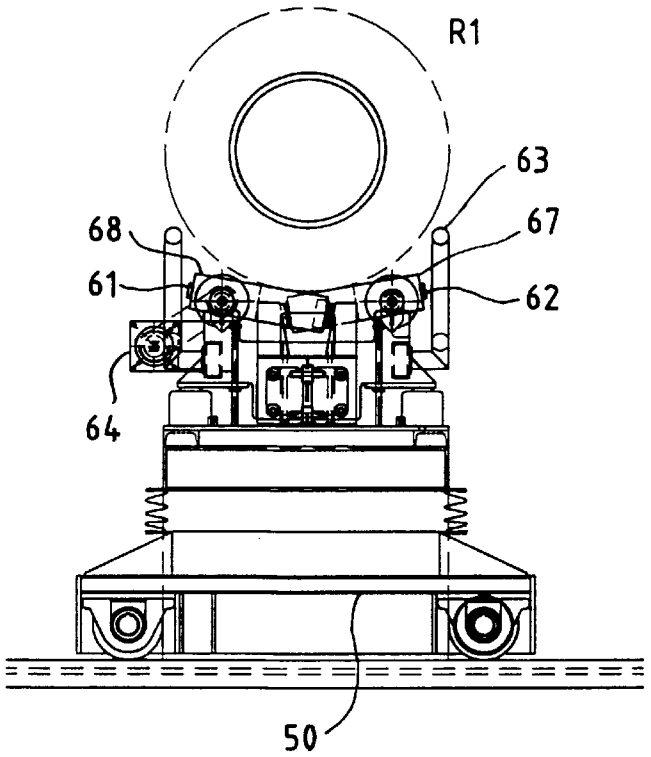
FIG. 15 is a view similar to FIG. 13 showing the roll $R_1$ in a lowered position.

When the expired roll $R_1$ is to be discharged, the rollers 61 and 62 are lowered so that the roll $R_1$ is supported by the transverse end rollers 67–70 as illustrated in FIGS. 15 and 16. Each set of rollers forms a general V-configuration so that the expired core nests on the angled rollers.

Figure 17:
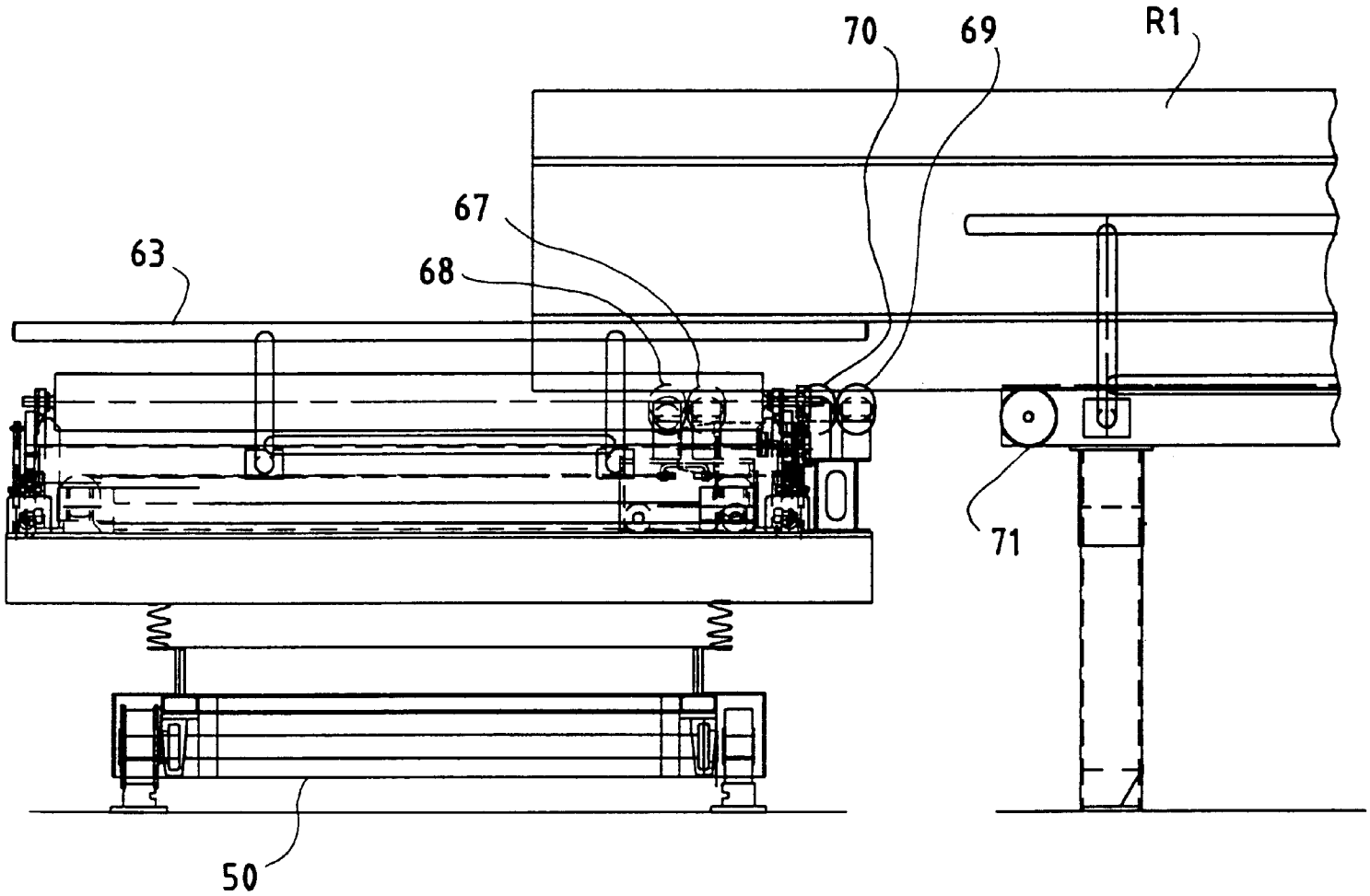
FIG. 17 is a view similar to FIG. 16 showing the roll $R_1$ being discharged.

The rollers 67 and 68 are movable toward the rollers 69 and 70, and the expired roll $R_1$ is discharged by moving the rollers 67 and 68 toward the rollers 69 and 70 as illustrated in FIG. 17. As the expired roll $R_1$ is moved to the right, the roll engages a conveyor 71 which discharges the expired roll from the cart.

The rollers 67 and 68 have bearings that permit the rollers to rotate clockwise but not counterclockwise. The rollers 69 and 70 can rotate in either direction. Accordingly, as the rollers 67 and 68 are moved toward the rollers 69 and 70, the rollers 67 and 68 do not rotate and transport the expired parent roll $R_1$ to the right as illustrated in FIG. 17. When the expired roll is continued to be discharged by the conveyor 71, the rollers 67 and 68 can rotate clockwise.

Although I have described both the parent roll placement cart and the core removal cart as being movable in both the x and y directions, it is possible that either or both of the carts could be movable in only one of the x and y directions. The frames and/or chucks could be movable in the other direction so that the chucks can be aligned with the core of the parent roll.

Figure 18:
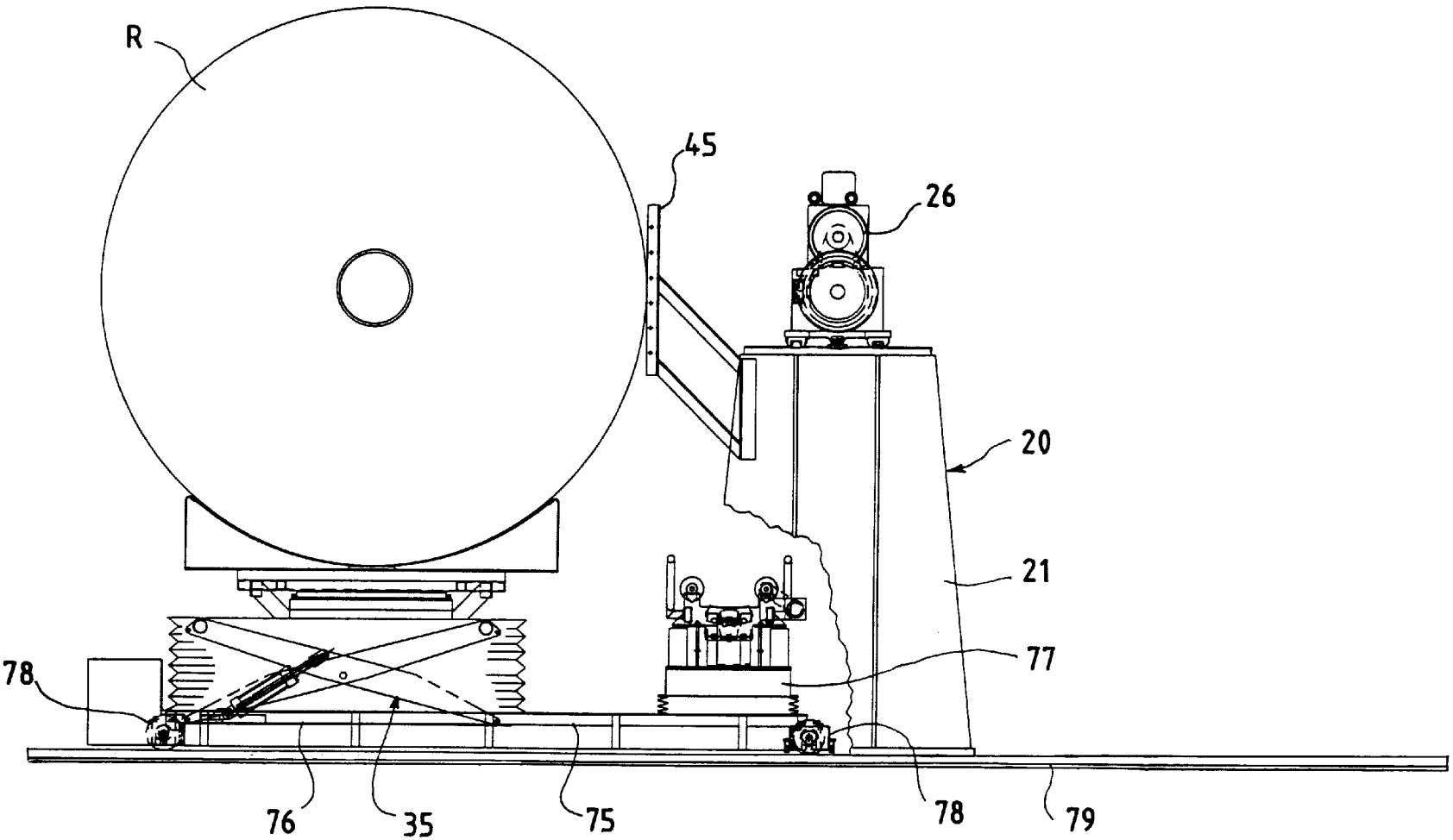
FIG. 18 is a view similar to FIG. 1 showing a single roll handling cart which includes a parent roll handling portion and a core removal portion.

The invention can also use a single cart to combine the functions of parent roll placement and core removal rather than using a separate parent roll placement cart and a separate core removal cart. Referring to FIG. 18, a roll handling cart 75 includes a parent roll handling portion 76 and a core removal portion 77. The cart 75 includes wheels 78 which ride on rails 79.

The parent roll placement portion 76 of the cart is constructed in substantially the same way as parent roll placement cart 30, and the core removal portion 77 of the cart is constructed in substantially the same way as the core removal cart 50.

FIG. 18 illustrates the unwind being loaded for the first time. The roll handling cart 75 is moved in the Y direction so that roll R can be chucked up by the unwind 20.

Figure 19:
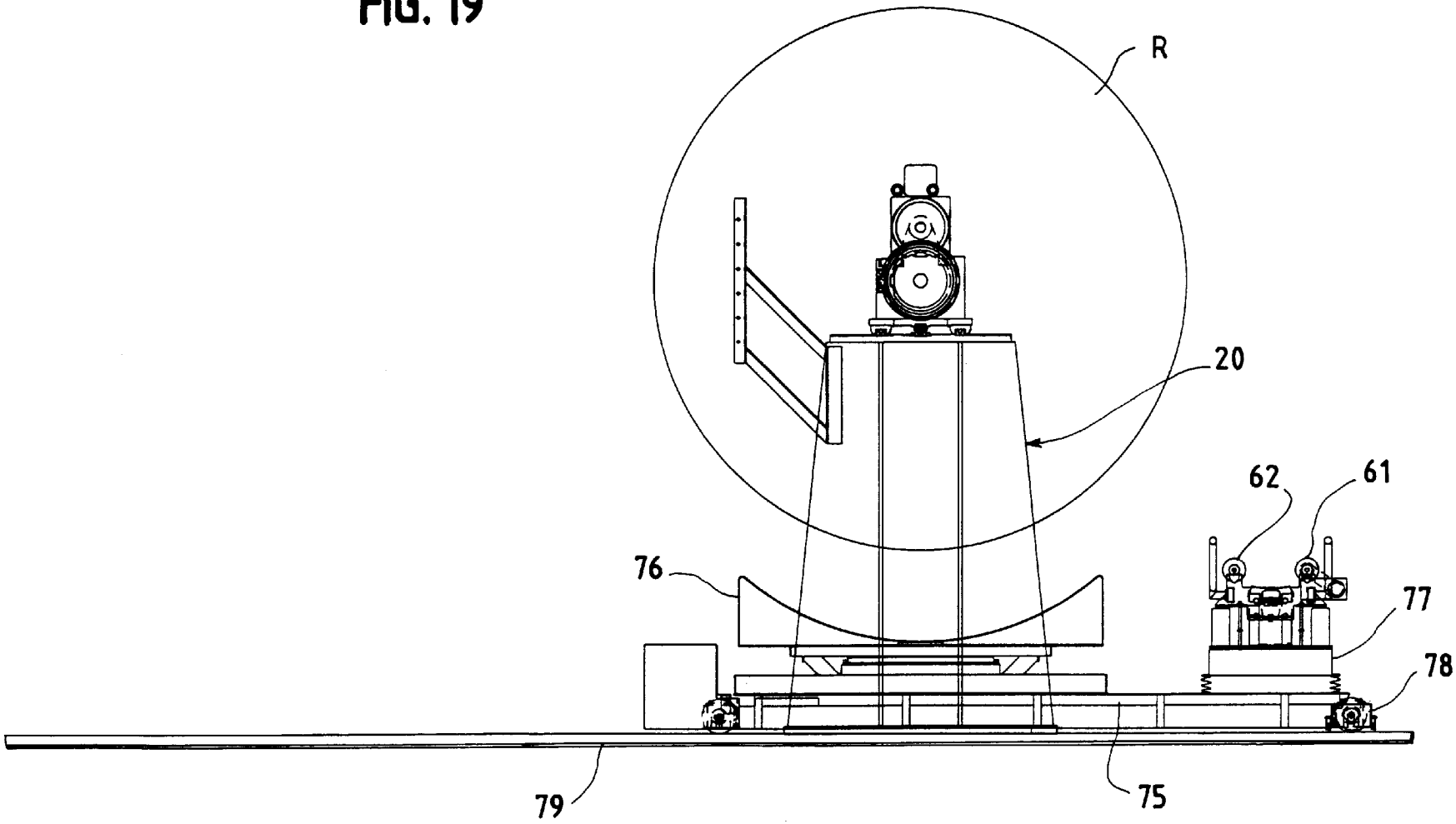
FIG. 19 illustrates the single cart of FIG. 18 after an initial parent roll is chucked up in the rewinder.

FIG. 19 illustrates the parent roll handling portion 76 of the cart in a lowered position after the parent roll R has been chucked up.

Figure 20:
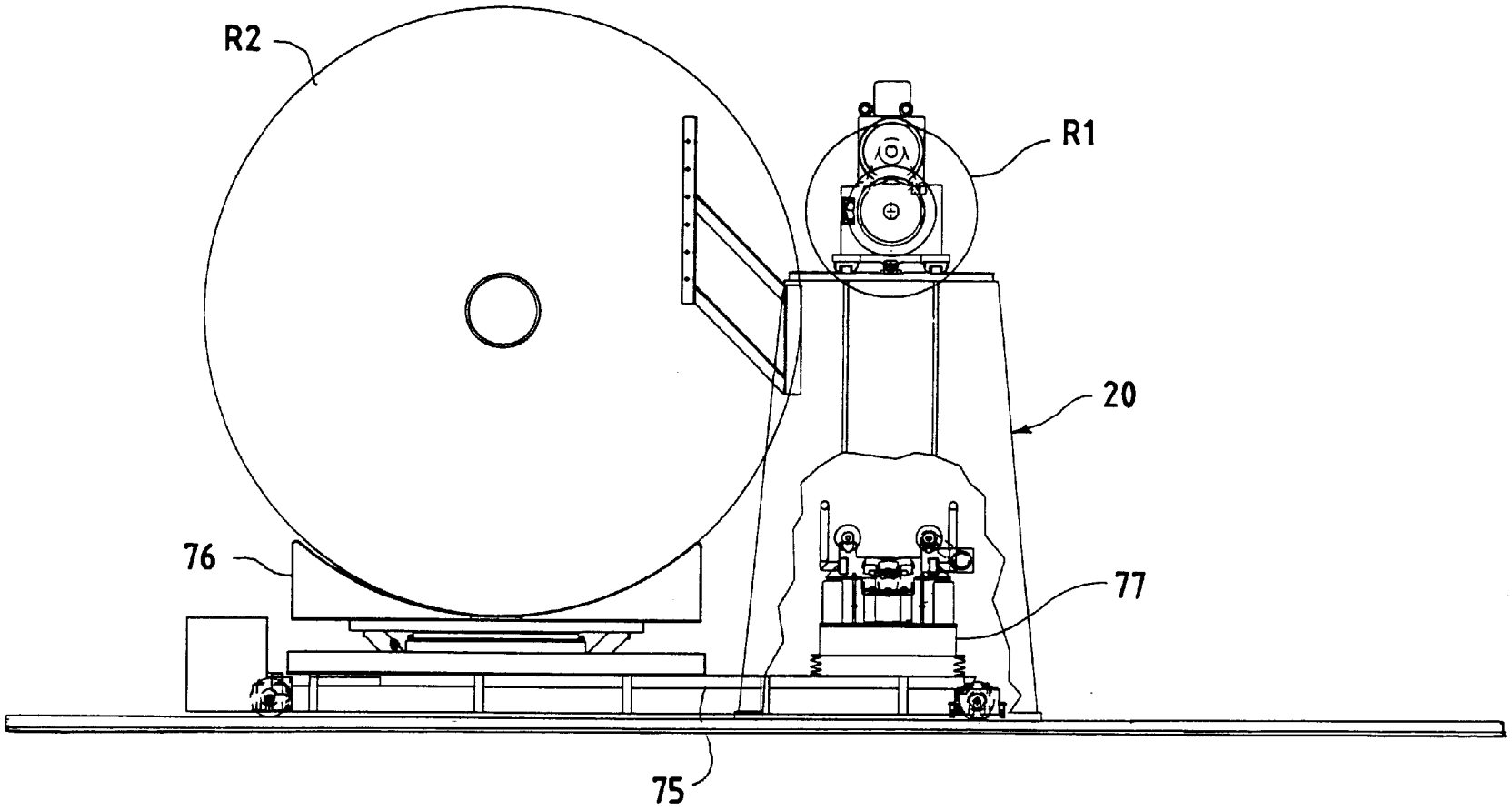
FIG. 20 illustrates a new parent roll being supported by the parent roll placement portion of the single cart.

FIG. 20 illustrates the cart 75 loaded with a new parent roll $R_2$ while a parent roll $R_1$ is being unwound on the unwind 20. The new parent roll $R_2$ is loaded onto the cart while the cart is in the position illustrated in FIG. 18. The core removal portion 77 of the cart is positioned below the unwinding parent roll $R_1$ in FIG. 20.

Figure 21:
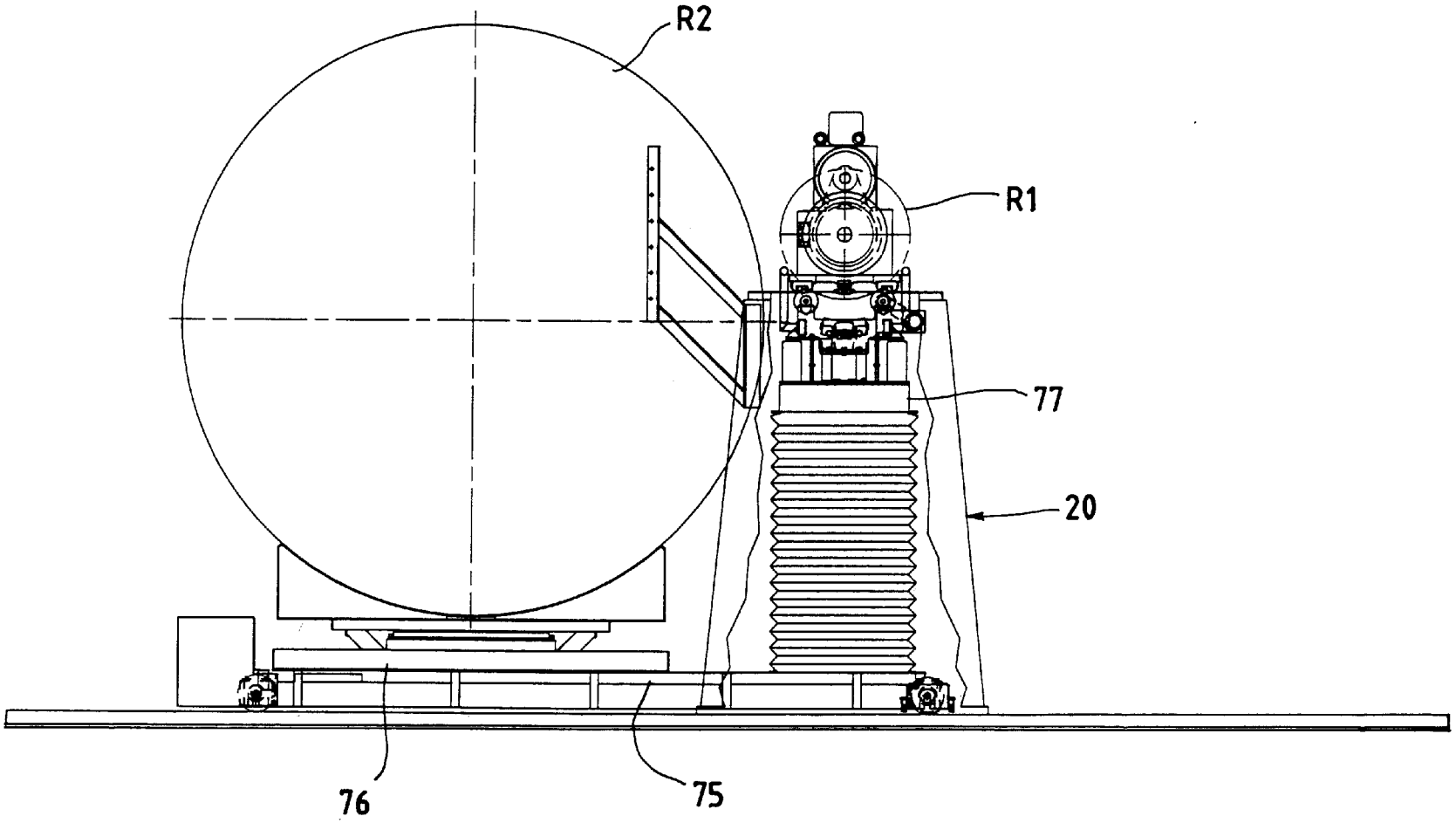
FIG. 21 illustrates the core removal portion of the single cart removing the expiring parent roll.

FIG. 21 illustrates the core removal portion 77 of the cart being raised to support the expiring parent roll $R_1$. When the expiring parent roll $R_1$ is supported by the core removal portion 77, the roll $R_1$ can be unchucked from the unwind 20.

Figure 22:
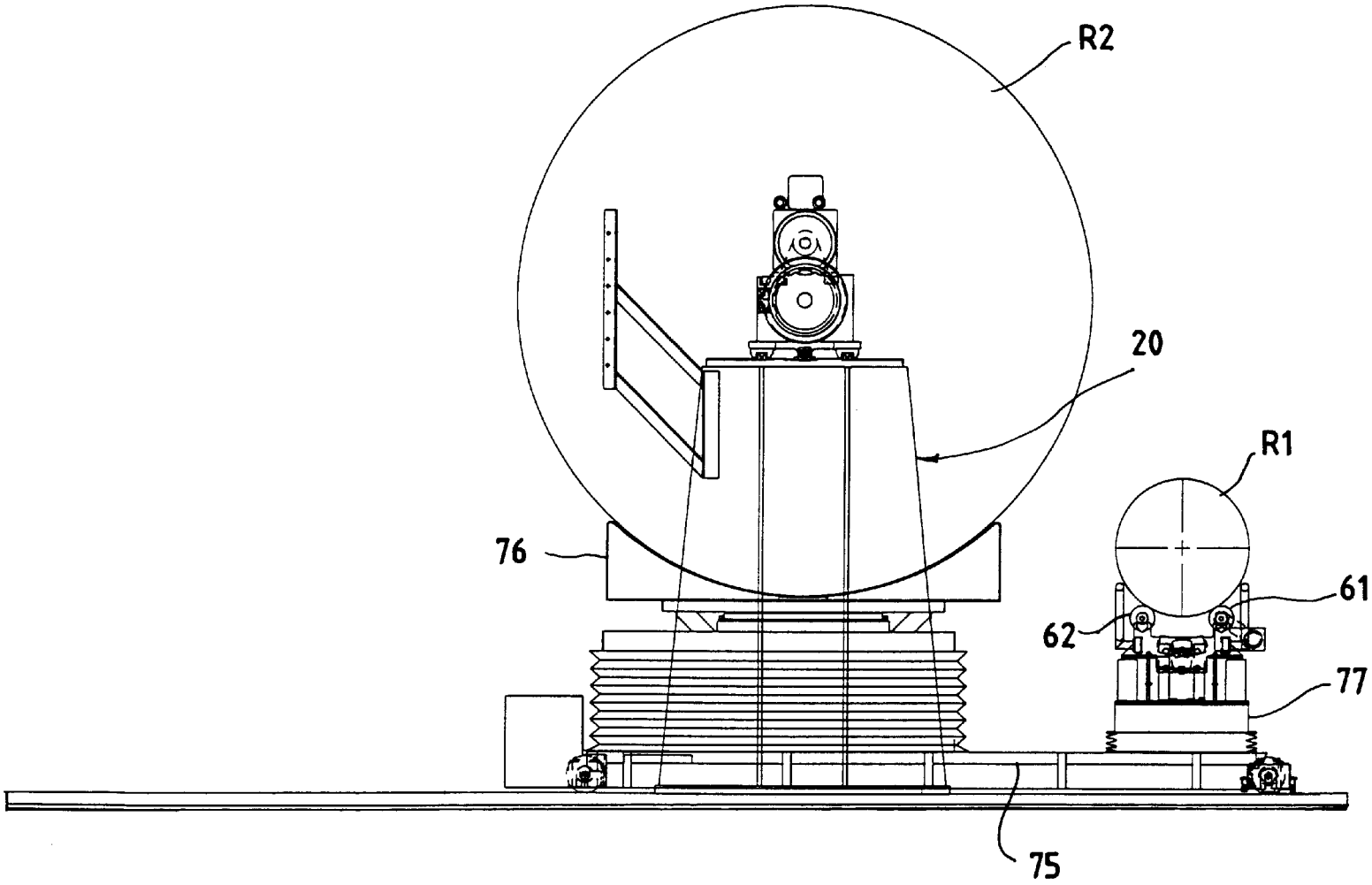
FIG. 22 illustrates the single cart moving a new roll into the unwinder.

The cart 75 is thereafter moved to the right, and the core removal portion 77 is lowered as illustrated in FIG. 22. The roll $R_1$ is continued to be unwound by the driven roller 61 of the core removal portion 77. After the new parent roll $R_2$ is chucked up, the new parent roll is threaded up as previously described.

While in the foregoing specification a detailed description of a specific embodiment of the invention was set forth for the purpose of illustration, it will be understood that many of the details herein given can be varied considerably by those skilled in the art without departing from the spirit and scope of the invention.

I claim:

1. A center driven unwind system for core-equipped parent rolls comprising:

a frame including a pair of horizontally spaced-apart side frames, a retractable chuck on each of the side frames for insertion into a parent roll core, a first cart portion for supporting a new core-equipped parent roll, means on the first cart portion for moving a new parent roll from a first position in which the new roll is not between said side frames to a second position in which the new roll is between said side frames and said chucks can be inserted into the core of the new roll, and a second cart portion for supporting a partially unwound core-equipped parent roll, means on the second cart portion for moving the partially unwound roll from a first position in which the partially unwound roll is between the side frames and said chucks are inserted into the core of the partially unwound roll to a second position in which the partially unwound roll is not between the side frames.

2. The unwind system of claim 1 in which the first and second cart portions comprise separate carts.

3. The unwind system of claim 1 in which said first and second cart portions are part of a single cart.

4. The unwind system of claim 1 in which said moving means on the first cart portion includes a lift assembly for moving a new parent roll vertically.

5. The unwind system of claim 1 in which the first cart portion includes a cradle for supporting a parent roll and said moving means on the first cart portion includes a lift assembly for moving the cradle vertically.

6. The unwind system of claim 1 including feedback means for positioning the first cart portion in both the first and second positions.

7. The unwind system of claim 1 in which said moving means on the second cart portion includes a lift assembly for moving a partially unwound roll vertically.

8. The unwind system of claim 1 in which the second cart portion includes a pair of rollers for rotatably supporting and unwinding a partially unwound parent roll.

9. The unwind system of claim 8 in which said moving means on the second cart portion includes a lift assembly for moving the rollers vertically.

10. The unwind system of claim 1 including feedback means for positioning the second cart portion in both the first amd second positions.

11. The unwind system of claim 1 including a pair of rollers on the second cart portion for rotatably supporting a parent roll and means for rotating and braking one of the rollers.

12. The unwind system of claim 1 including a pivotable cradle on the first cart portion for supporting a parent roll.

13. A method of unwinding core-equipped parent rolls from an unwind stand having a pair of spaced-apart side frames and a retractable chuck on each of the side frames for insertion into a parent roll core comprising the steps of:

supporting a core-equipped parent roll on a first movable cart portion, the roll having a web wound thereon, moving the first cart portion from a first position in which the roll is not between said side frames to a second position in which the roll is between said side frames and said chucks can be inserted into the core of the roll, inserting the chucks into the roll to support the roll on the chucks, moving the first cart portion from the second position to the first position, at least partially unwinding the web from the roll while the roll is supported by the chucks, moving a second movable cart portion from a first position in which the second cart portion is not between the side frames to a second position in which the second cart portion is in position to support the roll, retracting the chucks from the roll so that the roll is supported by the second cart portion, and moving the second cart portion and the roll to the second position of the second cart portion.

14. The method of claim 13 including the step of rotatably mounting the roll on the second cart portion and continuing to unwind the web from the roll while the roll is supported by the second cart portion.

15. The method of claim 14 including the steps of supporting a second core-equipped parent roll on the first cart portion when the first cart portion is in its first position, the second roll having a web wound thereon, moving the first cart portion and the second roll to the second position of the first cart portion, inserting the chucks into the second roll so that the chucks support the second roll, unwinding the webs from both of the rolls, and joining the webs.

16. The method of claim 14 in which the first and second cart portions are part of a single cart and the first and second cart portions are moved together.

* * * * *

UNITED STATES PATENT AND TRADEMARK OFFICE

CERTIFICATE OF CORRECTION

PATENT NO. : 5,934,604
DATED : August 10, 1999
INVENTOR(S) : Wayne D. Klimek

It is certified that error appears in the above-identified patent and that said Letters Patent is hereby corrected as shown below:

Column 8,
Line 3, the second occurrence of "second" should read -- first --.

Signed and Sealed this

Fourteenth Day of May, 2002

*Attest:*

*Attesting Officer*

JAMES E. ROGAN
*Director of the United States Patent and Trademark Office*

UNITED STATES PATENT AND TRADEMARK OFFICE
Certificate

Patent No. 5,934,604 Patented: August 10, 1999

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Wayne D. Klimek, Green Bay, WI; and Daniel J. Moran, Appleton, WI.

Signed and Sealed this Eighth Day of April 2003.

KATHERINE MATECKI
*Supervisory Patent Examiner*
Art Unit 3654